US005083617A

United States Patent [19]

Pierce, Jr.

[11] Patent Number: 5,083,617

[45] Date of Patent: Jan. 28, 1992

[54] FIRE BLANKET SYSTEM

[76] Inventor: Webster A. Pierce, Jr., 223 W. 58th St., Cut Off, La. 70354

[21] Appl. No.: 25,494

[22] Filed: Mar. 13, 1987

Related U.S. Application Data

[63] Continuation-in-part of Ser. No. 633,511, Jul. 23, 1984, Pat. No. 4,650,002.

[51] Int. Cl.[5] ..... A62C 3/00; B27N 9/00

[52] U.S. Cl. ..... 169/50; 169/47; 169/46; 428/102; 428/192; 428/920

[58] Field of Search ..... 169/50, 46, 47, 48, 169/49, 54, 70, 65; 428/192, 102, 920

[56] References Cited

U.S. PATENT DOCUMENTS

| | | | |
|---|---|---|---|
| 1,027,308 | 5/1912 | Bishop . | |
| 2,183,113 | 12/1939 | Bennett . | |
| 2,595,833 | 5/1952 | Flaherty . | |
| 2,720,269 | 10/1955 | Diacos . | |
| 3,107,361 | 12/1963 | Glutting, Sr. . | |
| 3,805,872 | 4/1974 | Lorber . | |
| 3,828,856 | 8/1974 | Wallace . | |
| 4,269,901 | 5/1981 | Chamberlain . | |
| 4,391,865 | 7/1983 | Constance | 428/192 X |
| 4,401,707 | 8/1983 | Bailey et al. | 428/102 X |
| 4,483,314 | 11/1984 | Parker, Jr. et al. . | |
| 4,597,450 | 7/1986 | Budmiger | 169/50 |
| 4,650,002 | 3/1987 | Pierce, Jr. | 169/50 |

FOREIGN PATENT DOCUMENTS

| | | | |
|---|---|---|---|
| 15685 | of 1903 | United Kingdom . | |
| 2103084 | 2/1983 | United Kingdom | 169/50 |

*Primary Examiner*—Joseph F. Peters, Jr.
*Assistant Examiner*—Virna Lissi Mojica
*Attorney, Agent, or Firm*—C. Emmett Pugh

[57] ABSTRACT

A multi-layered fire extinguishing blanket including a fire-proof blanket of fire-resistant, fabric layer having a peripherally attached, non-porous, laminated almuinum layer on one side, creating insulating air pockets between the two, and two handles on the fabric backside of the blanket for manually grasping the blanket prior to placing it over a fire aluminum side down. The handles are mounted at positions spaced substantially below the top edge of the blanket, so that a portion of the blanket between the handles and the top edges, which is of a material having little if any rigidity, is allowed to drape back over, covering and protecting the hands, the handles also providing greater control of the blanket for more effective operation. A number of peripherally located, spaced magnets keep the fireproof blanket secured over the fire in a metallic environment and give sufficient, strategically located, peripherally spaced weight to the blanket, providing for a good throw and inherent opening characteristic to the blanket, when thrown over the fire. The aluminum layer serves as a heat sink and barrier to oil and grease, and as a water entrapping barrier when the fabric side is saturated with water in using the blanket in reverse fashion on a super hot fire. A set of supplemental handle straps is located at the top of the blanket stored in slots for pull-up/out and over use, when the blanket is to be positioned in reversed fashion (fabric side down) over the fire.

10 Claims, 5 Drawing Sheets

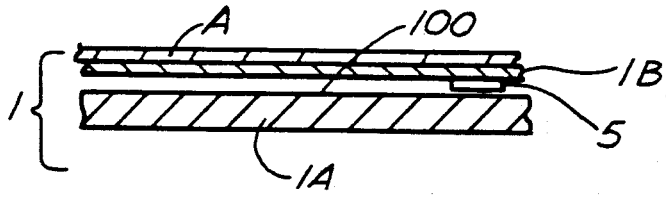
FIG. 12
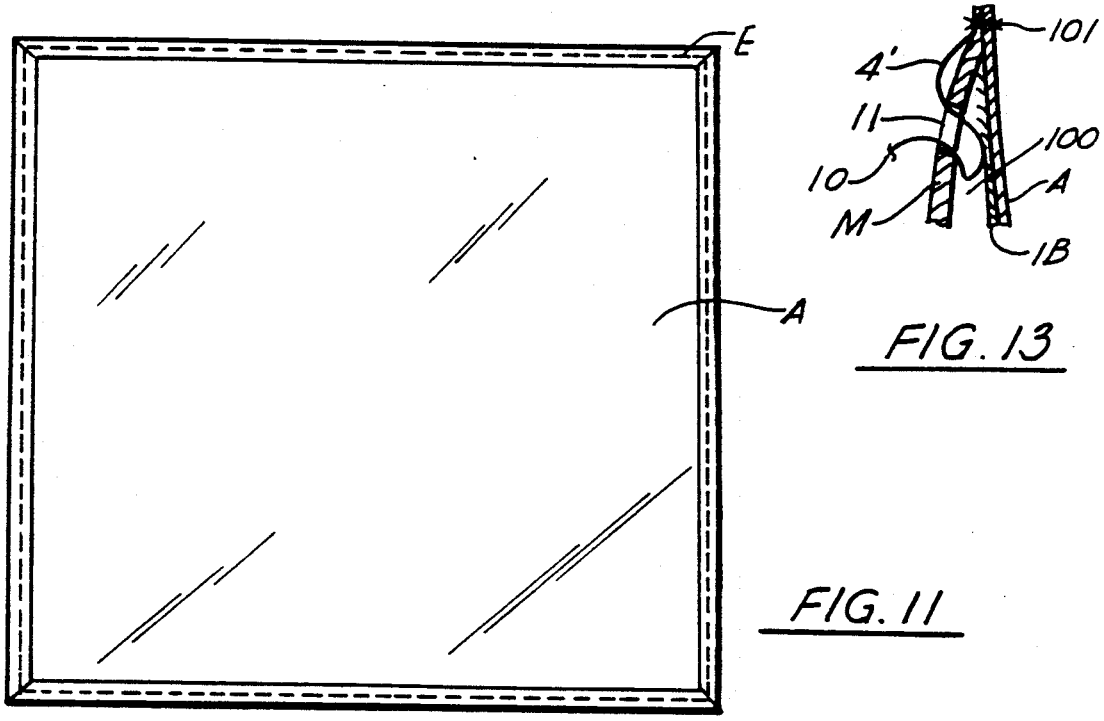
FIG. 13
FIG. 11
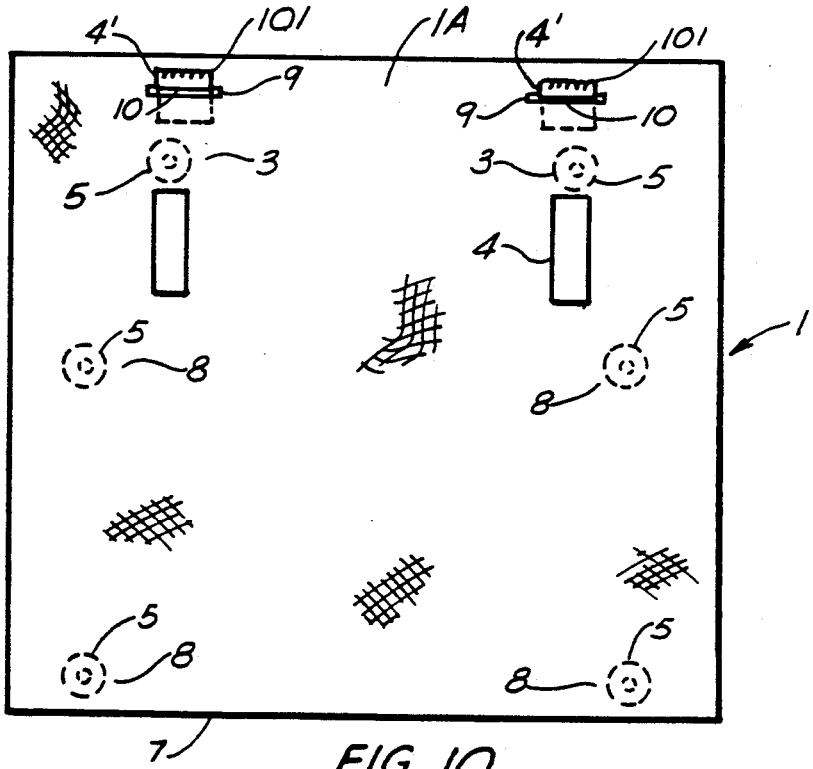
FIG. 10

FIRE BLANKET SYSTEM

REFERENCE TO RELATED APPLICATION

This application is a continuation-in-part of co-pending application Ser. No. 06/633,511, entitled "Magnetic Fire Blanket" filed July 23, 1984, being issued as U.S. Pat. No. 4,650,002, on Mar. 17, 1987, the disclosure of which, including both the written specification and drawings, is bodily incorporated herein by reference.

BACKGROUND OF INVENTION

1. Field of Invention

The present invention relates to a fire extinguishing device. More particularly, the present invention relates to a fire proof or fire resistant fire blanket used primarily to extinguish a fire having preferably a laminated aluminum surface thereon which covers substantially one side of the blanket, which, when the aluminum surface is placed over a fire in such a way that it covers the fire, extinguishes the fire by depriving the fire of oxygen; and which also preferably includes handles on the back side of the fire blanket for manipulating the fire blanket and preferably a plurality of magnets included with the blanket as securing means to keep the fire blanket over the flames when in a metallic environment while smothering the flames.

2. Prior Art & General Background

A number of prior art patents exist which teach various different forms of fire extinguishing blankets. However, the fire blanket embodied in the present invention is a significant advancement over the blankets of the prior art.

For example, British Patent No. 15,685 to Edmond in 1903 teaches the use of a blanket or cover-up material which was chemically treated or otherwise rendered fireproof or made of a fireproof material which was to be rectangular in shape with the words "fire" or "fireproof" printed on the corners of the cover. The cover also included a means for hanging it on the wall, which required a special bracket to be mounted on the wall. It was contemplated the blanket could be used to put out small fires, for example, "lamp explosions", by it being snatched or quickly picked up, and placed over the flames to smother the flames. The material was thought to be fireproof, and it was noted that the blanket could be made of distinctive colors.

In 1912, U.S. Pat. No. 1,207,308 was issued to Bishop which suggests the mounting of a fire blanket so that it could be readily removed from its mounting on the wall. This was accomplished by means of a foreign metal mounting clip attached to the blanket, which was snapped over a special bracket mounted on the wall.

A fire blanket was suggested by U.S. Pat. No. 2,702,269, which issued in 1953 to Diacos, and is likewise rectangular in form and weighted for casting or throwing in a convenient manner over a fire in for example a household.

A fire blanket patent, U.S. Pat. No. 3,828,856 which issued in 1974 to Wallace, suggested that a blanket could be of a fire resistant material and could be used to extinguish a fire in a saucepan or for burning fat, with the blanket to be washed and replaced after use. Wallace also suggested a novel method for mounting the blanket, which required the folding of the blanket. and its placement in a storage bag.

For additional prior patents which may be of interest, see U.S. Pat. No. 2,183,113 to Bennett which issued in 1938, and U.S. Pat. No. 4,269,901 to Chamberlain which issued in 1981.

As will be seen, the prior art does not teach the aluminum/fabric structure of the present invention. Although it is known to have an outer aluminum covering over clothing of fire resistant material such as "Nomex" worn by fire fighters and the like in the non-analogous art of "entry" suits, even in that art such outer layer is secured, it is believed, over most if not all of its interfacing surface with the underlying fabric material and does not at least generally include a multi-layer, spaced construction with air pockets or insulating air layers between them.

Nor does the prior art teach the use of closed handles or of magnets as mounting means for storage of the blanket. Nor does the prior art teach the use of magnets as securing means to keep the fire blanket over the flames in a metallic environment while smothering them. The prior art likewise also does not teach the positioning of handles, causing the top of the blanket to drape down, to allow an operator to protect himself, while approaching a fire which is to be extinguished, or particularly for super hot fires to wet down the fabric of the blanket and have for example supplemental handles for use in applying the fire extinguishing blanket in reverse fashion, namely aluminum side up.

General, Summary Discussion of the Invention

An object of the method and apparatus of the fire blanket system of the present invention is to provide a fire extinguishing device which can be used by anyone in a kitchen area or other similar surrounding without having to use a bulky, expensive, mechanical device such as a conventional fire extinguisher. Accordingly, the method and apparatus of the present invention overcomes disadvantages of such devices including limited knowledge on the part of an intended operator, apprehension of use, and a lack of the device such as the fire extinguisher always being in a ready state.

A further object of the method and apparatus of the present invention is to provide a device which will be able to extinguish a fire on a stove without creating a mess or spoiling food nearby. For example, a common household chemical fire extinguisher will both create a mess and ruin other food being prepared in the vicinity, and a fire extinguisher, if not used correctly, can make a fire worse by gouging the burning objects and spreading the fire.

A further object of the method and apparatus of the present invention is to provide a fire blanket having a special, laminated aluminum surface thereon covering substantially one side of the blanket, and which preferably includes magnetic securing means for keeping the fireproof blanket secured over a fire when in a metallic environment, which can be used repeatedly without a need for a recharging, such as a fire extinguisher needs after use, or any other type of cost, an initial investment providing all the investment that is necessary.

Further, the method and apparatus of the present invention avoids a hazard which may be created when water is applied to a stove fire, often resulting in an explosive situation, by providing a fire blanket having a magnetic securing means for keeping the fireproof blanket secured over the fire when in a metallic environment, which covers and smothers the fire, and which is held securely over the fire by the magnetic securing means.

Accordingly, the fire blanket of the present invention by providing magnetic securing means for keeping the fireproof blanket secured over a fire, when in a metallic environment, has a unique property which will enable the operator to extinguish a fire in less than two or three seconds.

The fire blanket of the present invention is noticeably displayed, conveniently located, easily recognized and simply used in case of emergency. The fire blanket of the present invention can be made of a brightly colored material, and can have a clearly distinct visible identification, indicating it is to be used to extinguish fires. Because of its magnets, the fire blanket of the present invention, if sufficiently light in weight, can be stored directly on any metallic surface of the refrigerator or any metallic surface in for example the kitchen. The fire blanket of the present invention may also be stored, for example, draped over a dowel, which is suspended or extends outward from the kitchen wall.

The fire blanket of the present invention can also be used in an emergency situation to protect oneself or a child or other person or an animal when trying to escape a fire.

The magnetic fire blanket preferably is made of an inherently fire resistant or fire proof fabric. The flame resistant characteristic can be part of the fiber itself, rather than just an additive, coating or special treatment. Its protective quality thus cannot be washed out or worn off.

The laminated aluminum surface covering substantially one side of the blanket of the fire blanket of the present invention provides an inherently fire resistant or fireproof surface. Accordingly, the fire blanket of the present invention, when so constructed, provides protective qualities which cannot be washed or worn off.

The fire blanket of the present invention is also attractive to serve a secondary function as a decorative display when not in use.

The fire blanket of the present invention is preferably for example in dimensions around a twenty-four by thirty inch rectangle for home use and around a thirty by thirty-six rectangle square for commercial applications, because such sizes would cover most cooking pots that will be used on a stove in a home or in restaurants, respectively.

The fire blanket of the present invention preferably has at least two handles which can be, for example, six and one half or seven inches in length, so a person can hold the fire blanket and protect the upper part of the body and hands while approaching a fire, while allowing the operator to protect his or her body as the operator places the fire blanket over, for example, a burning pot. Additionally, a supplemental set of straps or smaller handles can be included for protectively holding and pulling the blanket over for applying it to a fire in reverse fashion, allowing the fabric portion to be wetted, when fighting for example a super hot fire. In such wetting, the laminated aluminum layer serves to restrain and distribute the water over and throughout the fabric, increasing its water holding capacity.

In the dampened mode and/or with the aluminum layer, the blanket of the present invention has several uniquely combined, advantageous effects, including

- the blocking out of oxygen from the fire;
- creating a barrier to any oil and grease on its interior, fire side to penetrating to said porous, fabric side;
- dampening, cooling effect on the fire and further combustion;
- the laminated aluminum layer serves as a heat sink, further enhancing the cooling effect of the blanket by dissipating the heat;
- moisture in the form of water droplets from the dampened fabric is turned into steam, further extracting heat from the underlying combustion area, as it changes from its water state to its steam state, and displacing any remaining oxygen in the combustion area as it expands in volume by a factor of 1600 to 1700 to one; and
- any water particles or droplets falling from the blanket produce a relative non-volatile mixture of fuel, oxygen and water which further diminishes combustion.

The fire blanket of the present invention has preferably for example six or seven magnets placed at strategic locations, so as to best benefit its location when placed on a metal surface, such as a stove or on a cooking utensil such as a pot, when trying to extinguish a stove fire. Such an arrangement holds the blanket securely over the flame, enabling the fire to be smothered quickly.

A portion of the magnets of the fire blanket of the present invention is preferably positioned just above the handle(s), so that they can be controlled when the blanket is prepared for use. The above-handle magnets are preferably located about three inches down from the top edge of the blanket to allow for a flap, should the magnets fall short of covering the area desired.

The remaining four or five magnets preferably are located at or near the edges so as to cause a dragging and anchoring effect at the peripheral edges of the blanket.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 10 is a rear or back view of the second "commercial" preferred embodiment of the fire blanket of the present invention, as shown in FIG. 7, showing the magnets located at positions on the blanket; and FIG. 11 is a front view of the preferred embodiment of the fire blanket of the present invention of FIGS. 1, 2, 7, 8, 9, and 10 showing the laminated aluminum surface.

FIG. 12 is a side, cross-sectional, partial view showing the preferred layered nature of the construction of the blanket for the embodiments hereof, including the fabric material, the air space, the plastic laminate surface and the aluminum sheet surface.

FIG. 13 is a side, detailed, partial, cross-sectional view showing the supplemental, top straps or small handles for applying the blanket to a fire in reverse side fashion.

DETAILED DESCRIPTION OF THE PREFERRED, EXEMPLARY EMBODIMENTS

Figure 1:
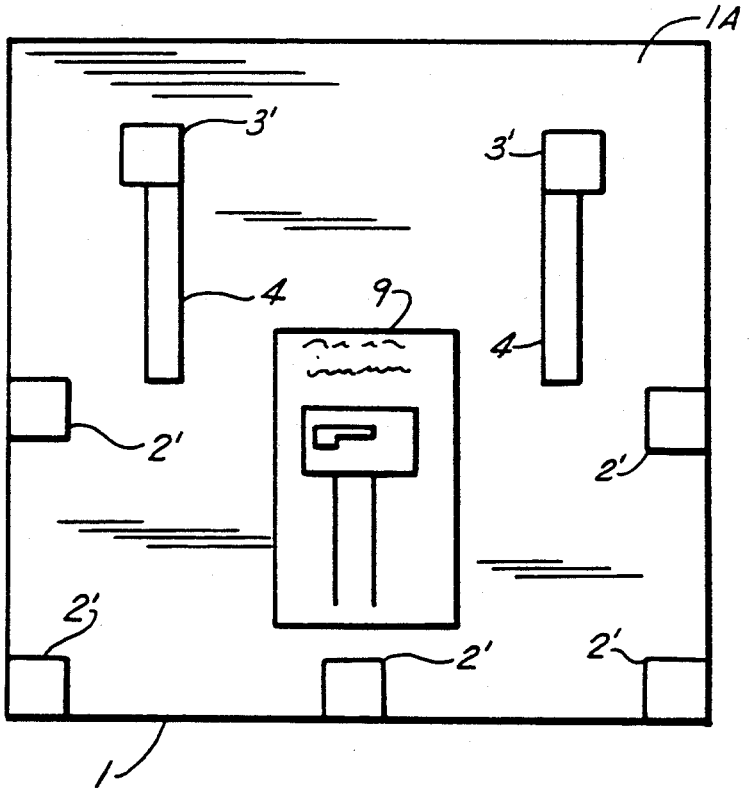
FIG. 1 is a rear or back view of a preferred embodiment of the fire blanket of the present invention showing the magnets located in pockets.
Figure 2:
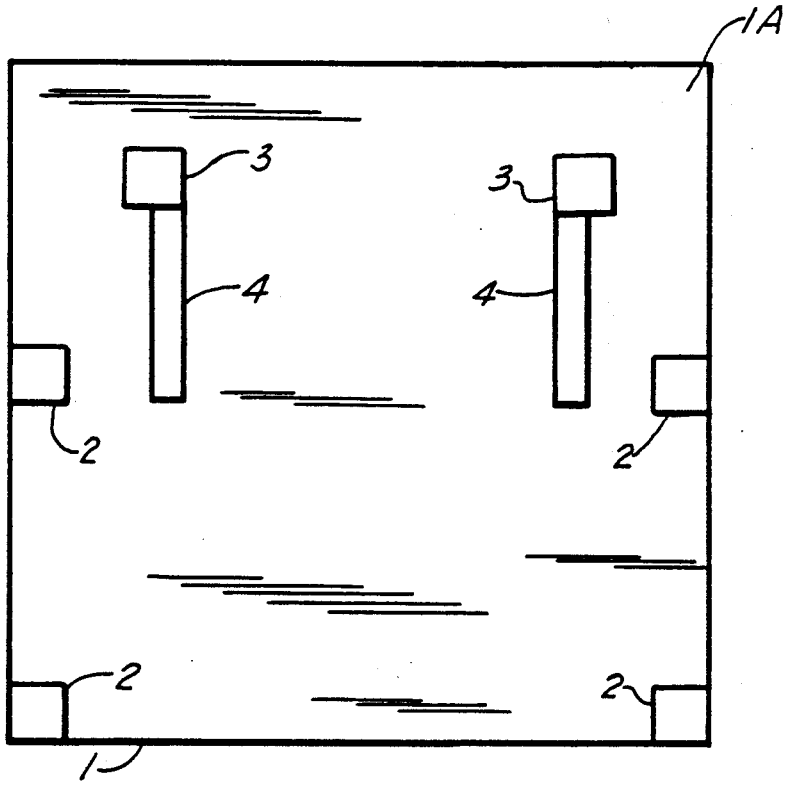
FIG. 2 is a rear or back view of a second preferred embodiment of the fire blanket of the present invention showing the magnets located in pockets.
Figure 7:
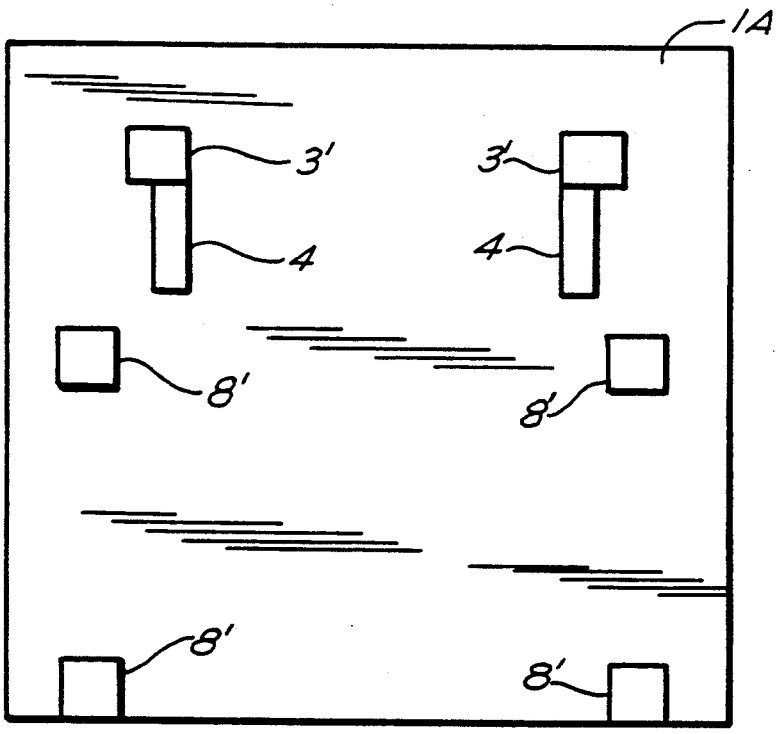
FIG. 7 is a back view of a second, "commercial" preferred embodiment of the invention, larger in size than the first embodiment, showing the magnets located in pockets.

Two preferred, exemplary embodiments of a fire blanket system according to the method and apparatus of the present invention are illustrated in FIGS. 1 and 7, respectively.

Figure 8:
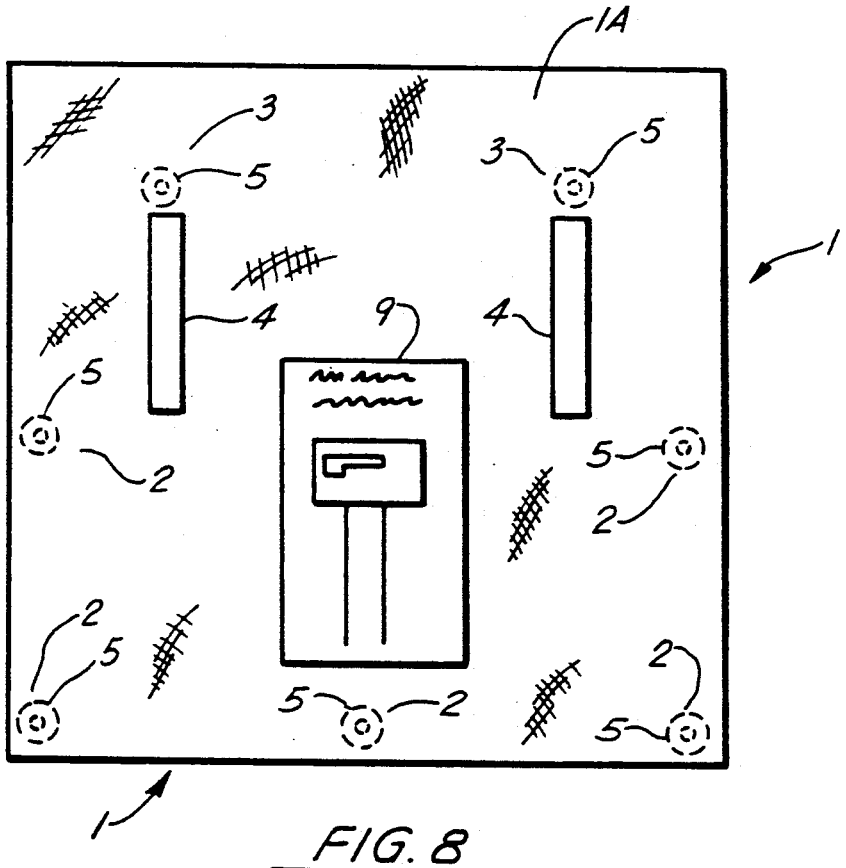
FIG. 8 is a rear or back view of the preferred embodiment of the fire blanket of the present invention, as shown in FIG. 1, showing the magnets located at positions on the blanket.
Figure 9:
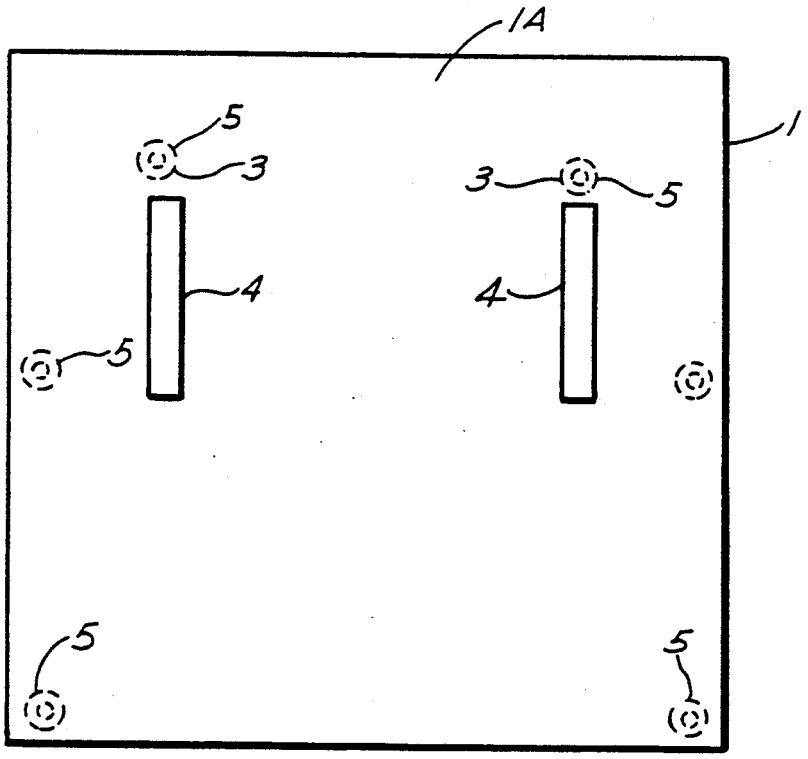
FIG. 9 is a rear or back view of the second preferred embodiment of the fire blanket of the present invention, as shown in FIG. 2, showing the magnets located at positions on the blanket.

As shown in the figures, the fire blanket, which is of particular use in the kitchen but of course can be used elsewhere as well, is made up of four basic elements:

- an exemplary twenty-four by thirty inch rectangle cloth or blanket 1 as shown in FIGS. 1 and 8 or an exemplary thirty by thirty-six inch rectangle cloth as shown in FIGS. 7 and 10, which comprises the body of the blanket, with the cloth being made of a suitable fire resistant material;
- a laminated impermeable or non-porous aluminum surface A, as shown in FIG. 11, thereon which covers substantially one side of the blanket;
- a plurality of magnets 5, which may be attached to the aluminum surface A at positions indicated by reference numbers 2, 3 or 8, as shown in FIGS. 8–10, or located in pockets 2', 3', or 8', as shown in FIGS. 1–4, and 7, of the blanket, and which provides magnetic securing means for keeping the fireproof blanket secured over a fire when in a metallic environment; and
- a pair of handles 4, which are attached to the back side 1A of the blanket.

The laminated aluminum surface A may be a single, preferably non-porous layer which has been rolled or compressed into a thin layer by suitable means known to the art, or may be a plurality of layers of laminated aluminum. The heavier gauge aluminum and lamination allow more stress to be placed on the aluminum without substantial harm, such as pin holes or tearing, allowing the blanket to take sharp creasing and crumpling with little or no structural damage, while the plurality of layers provides lighter aluminum and more flexibility.

Furthermore, the plurality of layers provides, should one layer of aluminum fail because of pin holes or tears, further layer(s) of aluminum to act as backup, thus preventing, for example, hot oils from penetrating the non-porous aluminum surface A to contaminate the fabric portion of the blanket. The aluminum surface A may be attached to the blanket by suitable means, such as for example merely sewing the peripheral edges together (note seam 101 of FIG. 13) or by folding the peripheral edge of the blanket over the edge of the aluminum surface A and sewing along the peripheral length of the folded edge E, as indicated in FIG. 11, fixedly connecting the peripheral edges of the aluminum surface A to the blanket.

As may be appreciated, the non-porous laminated aluminum surface A prevents breathing of the fire by restraining or blocking fresh air from reentering the fire area to keep the fire going. Further, the laminated aluminum surface A prevents the penetration of heated oil vapors and thus protects the exterior fire resistant material from being soaked with hot flammable oil vapors and burning. The aluminum layer A preferrably includes a laminar backing layer 1B note FIGS. 12 & 13) of for example polyester.

Also, the aluminum layer(s) A operate as a heat sink, dissipating and carrying the heat away from the fire.

As may be further appreciated, the aluminum surface A may have a bright, reflective surface which faces the flames of the fire for reflecting substantial amounts of heat due to its reflective property. Accordingly, the reflective properties provide means for reducing the amount of heat transferred through the aluminum surface A to the rest of the fire proof blanket, allowing the fire proof blanket to retain a comparatively cool surface temperature.

Further, the laminated aluminum surface A, which may be for example as much as paper thin, together with the bright reflective surface and the limited exposure time to the fire before it is extinguished, provides an insulation value as great as other insulating materials which may be several inches thick. Accordingly, the laminated aluminum surface A and the remainder of the blanket have their insulating values greatly increased, with an additional increase in the insulating value being due to an additional insulating effect of air between the layers and the blanket.

The magnets 5 may be attached to the aluminum surface A at positions 2, 3 and , as indicated in FIGS. 8–10, by suitable means such as glue, with the magnets 5 preferably being located between the aluminum surface A and the fire proof blanket.

Alternately, the magnets 5 may be attached in pockets 2', 3' and 8', as shown in FIGS. 1–4 and 7, which may be squares of cloth having an exemplary two inch dimension and sewn into the blanket at the locations shown in FIGS. 1–4 and 7. As shown in the figures, three sides are permanently secured, while the fourth is left open to accommodate the insertion of one of the magnets 5 as shown in FIG. 5. Once the magnets 5 are in place, the fourth and final edge of the pockets 2', 3' and 8' may be secured by either permanent or temporary closure means.

As may be further appreciated, the magnets 5 may be attached between the plurality of laminated layers of aluminum, if such is used, or between the aluminum layer A and the cloth or fabric material layer 1A, allowing for some air spaces between the layers (note FIG. 12), which air space helps provide better insulation qualities.

The handles 4, which may be an exemplary six and a half to seven inches long and which may be formed for example from a nine by two and one half inch piece of rectangular fire resistant cloth, are attached as shown in FIGS. 1–4, 7 and 8–10, an exemplary five inches down from the top edge of the blanket on the back side. These handles 4 are located on the back side of the fire blanket, in order to allow the operator of the fire blanket to protect himself from the fire when approaching the flames. Additionally, because the blanket is made up of a composite structure having little or no inherent rigidity, the top portion of the blanket has a tendency to drape back over the handles under the force of gravity, further protecting the hands of the user.

Additionally, as shown in FIGS. 10 and 13, a set of supplemental straps or smaller handles 4' may be included at the top of the blanket 1, normally tucked into slots 11 in a double layer (note FIG. 13). When desired for use, the tips 10 of the straps 4' are pulled out, pulling the main body of the straps 4' out of the interior cavity or chamber of the blanket 1 through the slots 11. As described more fully below, these supplemental handles 4' are primarily used in extinguishing super hot fires.

As shown in FIGS. 1–4, 7 and 8–10, a pair of magnets 5 located at position 3, or alternatively in pockets 3', are positioned directly above, but not substantially spaced from the handles 4, in order to provide control of a portion of the magnets 5 located at position 3, or which alternatively are located in pockets 3', in order to insure proper placement of these magnets 5 in relationship to the fire.

As shown in the figures, the magnets 5 located at position 3 are preferably fastened to the aluminum surface A between the aluminum surface A and the blanket by suitable means such as glue, or alternatively located in pockets 3', with position 3 or pocket 3' being, for example, three inches down from the top edge of the blanket and three and a half inches from the sides to allow for a flap to extend forward, should the magnets 5 fall short of covering the area desired.

The remaining five magnet positions 2 and 8, or magnet pockets 2' and 8', may be placed either at the edges (location 2 or pockets 2', with the upper pair being positioned for example twelve inches down from the top edge, and the bottom three spaced for example nine inches apart), so as to cause an anchoring effect when the blanket is placed over a burning object. Alternatively, for example, they could be placed about four inches in from the edge (location 8 or pockets 8', with the upper pair being positioned for example fourteen inches down from the top, and the bottom being spaced fifteen inches below the upper pair) to provide a covering flap, should the magnets 5 fall short of covering the desired area. These magnets 5 will secure the blanket to the surface of a stove surrounding, or at least act as weights on any non-metallic surface, weighing the blanket down over the fire and providing some desired peripheral weight to the blanket, assisting in the throwing and opening of the blanket as it is being thrown or guided.

Figure 3:
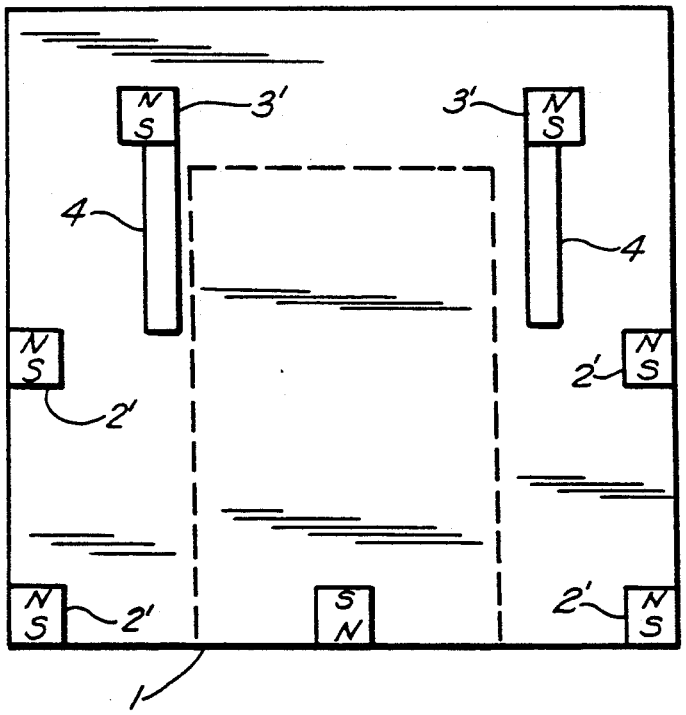
FIG. 3 is a further back view of the preferred embodiment of FIG. 1, showing a preferred fold line.
Figure 4:
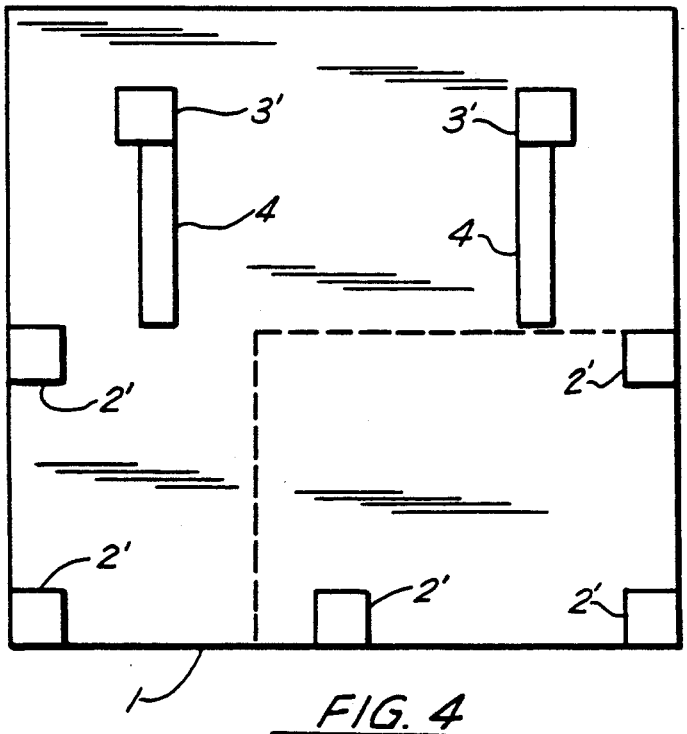
FIG. 4 is a further back view of the preferred embodiment of FIG. 1, showing a second preferred fold line.
Figure 5A:
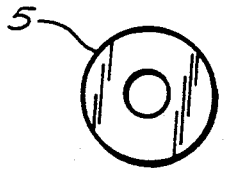
FIGS. 5 A & B are front and side views, respectively, of the magnets which are inserted into the pockets sewn into the fabric of the blanket.
Figure 5B:
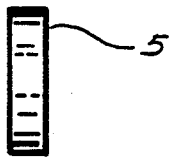
Figure 6:
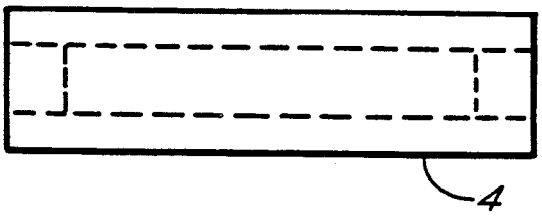
FIG. 6 is an unfolded view of one of the cloth handles of the blanket prior to folding and stitching.

The location of the preferred fold lines for folding the blanket, as for storage when not in use, are indicated by the dashed lines of FIGS. 3 and 4, with the dimensions of the folded blanket being, for example, twelve by fifteen inches. Along the fold lines, a reinforcement such as duct tape may be applied on the interior side of the laminated aluminum surface A between the aluminum surface A and the blanket, to reinforce this area on the aluminum surface A for allowing more stress to be placed by creasing during folding without creating any substantial damage to the aluminum surface A, while still allowing for flexibility.

In use, the magnetic fire blanket is held from behind by the operator grasping the two handles 4, one in each hand. The blanket is preferably oriented, so that the five perimeter magnets 5 located at positions 2 and 8, or alternatively located in pockets 2' and 8', are below the handles 4, thereby positioning the remaining portions of the magnets 5 at locations 3, or alternatively in pockets 3', directly above the handles 4. The flap, which may be an exemplary five inches of material above the handles 4, is allowed to drape back towards the operator, covering and protecting the operator's hands.

The operator then approaches the fire with the blanket held in front of him to protect him from the fire. The blanket is then placed or thrown over the flames and is secured in place by means of the magnets 5, and thus the fire is extinguished. The presence of the magnets 5, being a little over a half ounce each in weight and spaced about the blanket giving added momentum and direction to the blanket when it is thrown, causes the blanket to stay spread out and cover over the fire. The magnets 5 can be of the washer form type having for example a diameter of one and a quarter inch and a thickness of for example a quarter inch.

The preferred embodiment may also have imprinted upon it an attractive pattern, message or advertisement 9 (note FIGS. 1 and 8) and may be made of a brightly colored material. The blanket 1 should also have on it a visible identification or symbol which indicates that the blanket is to be used to extinguish fires. These features make the blanket visually appealing, and readily recognizable in the event a need to use the blanket suddenly arises.

The blanket can be made of any fire resistant, smothering material, and many such materials are known to the art. As may be appreciated, the magnetic fire blanket may be stored directly on the surface of a refrigerator or any other metallic surface in for example the kitchen. The kitchen fire blanket may also be stored, for example, draped over a dowel on which it is suspended or which extends outward from the kitchen wall.

When used under normal conditions, there will be no structural damage done to the magnetic kitchen fire blanket. All that has to be done is to spray the aluminum surface with, for example, a good household cleaner after exposure to oil vapors, wipe the aluminum surface clean and store the blanket, ready for its next use.

Further, the magnetic fire blanket may be used on types of fires which may be described as:

- cool, having a temperature range of for example five hundred to seven degrees (500–700) F.;
- hot, having a temperature range of seven to nine hundred (700–900) degrees F; and
- super hot, having a temperature range of for example nine hundred to fourteen hundred plus (900–1400+) degrees F.

As may be appreciated the cool fire is one in which cooking oil has reached its flash point and is into a burn for a short period of time. Accordingly when the blanket is applied to this type of fire, the fire will be extinguished simply by the elimination of oxygen.

With the hot fire, cooking oil has reached its flash point and is into a burn for generally less than one minute. When the blanket is applied to this type of fire, the fire is extinguished simply by the elimination of oxygen and the cooling of the fire by the heat sink effect of the laminated aluminum layer A. However, care must be taken to prevent a flash back, because the skillet or pot retains a lot of heat.

With the super hot fire, the fire can be extinguished rather easily by first dampening the fabric side 1A of the blanket or non-aluminum side before draping the blanket 1 directly over the fire. The fabric 1A can be dampened by for example pouring water or other fire extinguishing material directly over it, and the aluminum layer A serves as a water retainer and spreader, holding some additional water between it and the fabric. The presence of the aluminum backing layer A allows a great amount of water to be added to the fabric portion 1A. When the dampened blanket 1 is then turned over, fabric side 1A down and placed or thrown over the fire, the super hot fire is extinguished.

It is noted that when so applied, the additional water in the saturated blanket 1 does not pour out directly into the fire (e.g. burning oil), but is spread throughout the fabric 1A and emanates from the blanket 1 in the form of steam or discrete water droplets. This has the additional advantage of preventing oxygen from getting to the fire, converting water to steam which has a cooling effect by the absorption of heat as the water changes form from a liquid to a vapor, and the expansion of water into steam increases the volume of space occupied by the water to additionally displace the fuel and oxygen, and finally also adds water particles to the fuel/oxygen mix, further reducing combustion. The laminated aluminum surface is still very important in that it helps prevent oxygen from re-entry and helps keep steam from escaping.

The supplemental straps 4' can be used in easily grasping and directing the blanket 1 in applying the dampened blanket in reverse fashion (fabric side 1A down) unto the super hot fire. The straps 4' are grasped and pulled up and over to the aluminum side A of the blanket, causing the top portion of the blanket to be pulled and draped over the hands of the user, further protecting the hands of the user, particularly when the user decides to directly place the blanket over the fire, rather than just tossing it.

With this type of fire, due to the harshness of the fire and the extreme temperatures, the blanket may be destroyed by, for example, becoming full of oil which sill not wash out, and the chemical retardant qualities in the fire resistant blanket for some materials may be lost, because of the water removing the fire resistant chemical. This can in part be avoided by making the fire proof blanket of a material such as "Nomex", which will retain its fire resistant properties. However, any extreme quantities of oil may make the blanket unsuitable for further use. In the latter instance, if so desired, one may remove the aluminum layer A and wash the remaining cloth material for further use, reapplying a new aluminum layer, if so desired.

As may be further appreciated, the magnetic fire blanket of the present invention may be provided with a pouch which is of clear plastic to openly display or expose its contents. In addition, the pouch may be provided for example with "Velcro" type fasteners that may be used to attach the pouch to any surface, such as for example the refrigerator, the kitchen wall, inside or outside cabinet doors, or even slipped into a drawer.

The embodiments described herein in detail for exemplary purposes are of course subject to many different variations in structure, design and application. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A fire extinguishing blanket for placement over a fire to extinguish it, comprising:

a fire resistant, porous layer made of a fire resistant fabric material; and a non-porous aluminum layer thereon covering substantially one side of said porous, fabric layer, the non-porous aluminum layer serving as a heat sink for heat generated by the fire, a barrier to oil and grease on its exterior side from penetrating to said porous, fabric side, and a water restraining and spreading means for any water poured onto said porous, fabric layer;

at least one handle means mounted on the exterior side of said fabric layer, opposite said aluminum layer, for manually grasping the blanket prior to placing it over a fire, said handle means providing greater control of the placement of the blanket for more effective operation;

said handle means including at least one supplemental handle strap mounted on said fire resistant, fabric layer at the top edge of said fabric layer, the top portion of said fabric layer and said aluminum layer having little if any inherent rigidity, allowing the top edge with said strap to be pulled over to and around the aluminum layer side of the blanket, covering over and protecting the user's hand on said pulled over and around strap;

at least one slot in said fabric layer below said top edge leading to an air pocket between said layers, the main body of said strap normally being inserted through said slot and stored in said air pocket until needed for use.

2. The fire extinguishing blanket of claim 1, wherein: insulating air pockets are located between said porous fabric layer and said non-porous aluminum layer.

3. The fire extinguishing blanket of claim 1, wherein: said aluminum layer and said fabric layer are attached together only alone their peripheral edges, forming an air chamber between the two layers over most of their lateral extent, providing a large area insulating layer between the two layers.

4. The fire extinguishing blanket of claim 1, wherein: said laminated aluminum layer has a bright reflective surface disposed thereon on its exterior side which contacts the flames of the fire, reflecting substantial amounts of heat from the fire and reducing the amount of heat transferred through said aluminum surface to said porous fabric layer, allowing said fire resistant layer to retain a comparatively cool surface temperature on its exterior side.

5. The fire extinguishing blanket of claim 1, wherein there are two of said supplemental straps including two, parallel, laterally spaced handles, each of said handles including an elongated portion attached to said fire blanket at both ends to form a closed loop handle.

6. The fire extinguishing blanket of claim 1, wherein there is further included:

peripherally located and spaced magnetic securing means fixed to at least one of said layers, keeping said fireproof blanket secured over a fire by magnetic attraction when the fire is located in a surrounding metallic environment.

7. A fire extinguishing blanket, comprising:

a fire resistant layer of a fire resistant material;

at least one handle means for manually grasping said blanket prior to placing it over a fire, wherein said handle means is mounted on said fire resistant layer at a position spaced substantially below the top edge of said blanket, a portion of said blanket between said handle means and said top edge inherently tending to drape down under the action of gravity, the draping back towards the user covering over and protecting the user's hand(s) on said handle means, said handle means providing greater control of the placement of the blanket by the user for more effective operation; said handle means including two, parallel, laterally spaced handles of flexible fabric material;

magnetic securing means fixed to the blanket for keeping said fireproof blanket secured over the fire when in a metallic environment, including a plurality of perimeter magnets mounted in a spaced relationship along the perimeter of said blanket at positions below said handle means, providing significant, peripherally spaced weight, enhancing the throwing characteristic of the blanket; and two additional magnets, spaced inwardly from said perimeter and lying directly above, but not substantially spaced from said two handles, respectively.

8. The fire extinguishing blanket of claim 7, wherein the north poles of said two additional magnets and all of said plurality of perimeter magnets are oriented in the same direction.

9. The fire extinguishing blanket of claim 7, wherein there is further included:

a non-porous aluminum layer fixedly attached to said fire resistant layer, said fire resistant layer forming a porous, fabric layer of fire resistant material, said non-porous aluminum layer covering substantially one side of said porous, fabric layer, the non-porous aluminum layer serving as a heat sink, a barrier to oil and grease on its exterior side to penetrating to said porous, fabric side, and a water restraining and spreading means for water poured onto said porous, fabric layer.

10. The fire extinguishing blanket of claim 9, wherein: insulating air pockets are formed between said porous fabric layer and said non-porous aluminum layer.

* * * * *